US008354987B2

(12) United States Patent
Kida et al.

(10) Patent No.: US 8,354,987 B2
(45) Date of Patent: Jan. 15, 2013

(54) CONSTANT CURRENT CIRCUIT AND FLAT DISPLAY DEVICE

(75) Inventors: Yoshitoshi Kida, Kanagawa (JP); Yoshiharu Nakajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 1152 days.

(21) Appl. No.: 10/563,285

(22) PCT Filed: Jul. 6, 2004

(86) PCT No.: PCT/JP2004/009906

§ 371 (c)(1),
(2), (4) Date: Jan. 3, 2006

(87) PCT Pub. No.: WO2005/006303

PCT Pub. Date: Jan. 20, 2005

(65) Prior Publication Data

US 2006/0152461 A1 Jul. 13, 2006

(30) Foreign Application Priority Data

Jul. 9, 2003 (JP) ..... P2003-272443

(51) Int. Cl.
*G09G 3/36* (2006.01)
*G09G 3/10* (2006.01)
*G09G 3/30* (2006.01)

(52) U.S. Cl. ..... 345/98; 345/96

(58) Field of Classification Search ..... 345/98–100, 345/96

See application file for complete search history.

(56) References Cited

U.S. PATENT DOCUMENTS

| | | | | |
|---|---|---|---|---|
| 5,572,153 | A | 11/1996 | Vallancourt et al. | |
| 6,498,438 | B1 * | 12/2002 | Edwards | 315/169.3 |
| 6,611,107 | B2 * | 8/2003 | Mikami et al. | 315/169.1 |
| 7,095,991 | B2 * | 8/2006 | Tsuchi et al. | 455/159.1 |
| 2006/0267899 | A1 * | 11/2006 | Yamazaki | 345/97 |

FOREIGN PATENT DOCUMENTS

| | | | |
|---|---|---|---|
| EP | 0 899 712 | A2 | 3/1999 |
| EP | 0 899 714 | A2 | 3/1999 |
| EP | 0 899 714 | A2 | 3/1999 |
| EP | 1 274 068 | A2 | 1/2003 |
| EP | 1 333 422 | A1 | 8/2003 |
| JP | 62-122488 | | 6/1987 |
| JP | 07-295521 | | 11/1995 |
| JP | 08-265115 | A | 10/1996 |
| JP | 09-330060 | A | 12/1997 |

(Continued)

OTHER PUBLICATIONS

International Search Report mailed Oct. 19, 2004.

(Continued)

*Primary Examiner* — Amr Awad
*Assistant Examiner* — Randal Willis
(74) *Attorney, Agent, or Firm* — Rader Fishman & Grauer, PLLC

(57) ABSTRACT

The present invention is applied to, for example, a liquid crystal display in which a driving circuit is integrally formed on an insulating substrate, and after a sampling capacitor C3 is charged with a reference current I1 and a gate-source voltage Vgs of a transistor Q14 due to the reference current I1 is set in the sampling capacitor C3, the transistor Q14 is driven to function as a constant current circuit, by the voltage Vgs of the sampling capacitor C3.

9 Claims, 16 Drawing Sheets

FOREIGN PATENT DOCUMENTS

| | | | |
|---|---|---|---|
| JP | 11-073165 | | 3/1999 |
| JP | 2002-152565 | A | 5/2002 |
| JP | 2003-150109 | A | 5/2003 |
| WO | WO-01/26088 | A1 | 4/2001 |
| WO | WO-01/26088 | A1 | 4/2001 |
| WO | WO01/95596 | * | 12/2001 |
| WO | WO-02/39420 | A1 | 5/2002 |

OTHER PUBLICATIONS

International Search Opinion mailed Oct. 19, 2004.
Japanese Office Action for application No. 2003-272443 dated Jul. 1, 2008.
Daubert et al., "Operation and analysis of current copier circuits", IEEE Proceedings, vol. 137, Pt. G, No. 2, Apr. 1990.
Supplemental European Search Report issued Nov. 25, 2008 for corresponding European Application No. 04 74 7374.
Daubert, S.J et al: "Operation and Analysis of Current Copier Circuits" IEE Procedings G. Electronic Circuits & Systems, Institution of Electrical Engineers. Stevenage, GB, vol. 137, No. 2 Part G, Apr. 1, 1990, pp. 109-115, XP00102778; ISSN: 0622-0039.
European Patent Communication Pursuant to Article 94(3)EPC issued Aug. 28, 2012 for corresponding European Application 04 747 374.9-1228.

* cited by examiner

CONSTANT CURRENT CIRCUIT AND FLAT DISPLAY DEVICE

BACKGROUND OF THE INVENTION

1. Technical Field

The present invention relates to a constant current circuit and a flat display device, and the invention can be applied to, for example, a liquid crystal display in which a driving circuit is integrally formed on an insulating substrate. The present invention can reduce variations compared to conventional constructions by driving a transistor to function as a constant current circuit by means of a voltage of a sampling capacitor, after charging the sampling capacitor with a reference current and setting a gate-source voltage of the transistor due to the reference current in the sampling capacitor.

2. Background Art

Conventionally, in various integrated circuits, constant current circuits are constructed with current mirror circuits so as to supply currents necessary for the operations of individual sections. FIGS. 1 and 2 are connection diagrams respectively showing constant current circuits using current mirror circuits. The constant current circuit shown in FIG. 1 is adapted to fold back a reference current due to a P-channel MOS (hereinafter referred to as PMOS) Q1 by means of N-channel MOS (hereinafter referred to as NMOS) transistors Q2 and Q3 based on a current mirror circuit construction, thereby causing a constant current corresponding to the reference current to flow out from a desired circuit block, whereas the constant current circuit shown in FIG. 2 is adapted to fold back a reference current due to an NMOS transistor Q4 by means of PMOS transistors Q5 and Q6 based on a current mirror circuit construction, thereby causing a constant current corresponding to the reference current to flow out from a desired circuit block.

In recent years, a liquid crystal display device of the type in which a driving circuit for a liquid crystal display panel is integrally integrated and constructed on a glass substrate which is an insulating substrate constituting part of the liquid crystal display panel has been provided as a liquid crystal display device which is a flat display device applied to mobile terminals such as mobile phones and PDAs. In such a flat display device as well, driving circuits use the constant current circuits mentioned above in the connection diagrams of FIGS. 1 and 2.

Specifically, this kind of liquid crystal display device has a display section formed by pixels which are arranged in a matrix form and each of which is made of a liquid crystal cell, a polysilicon TFT (Thin Film Transistor) which is a switching device for the liquid crystal cell, and a storage capacitor, and it is constructed to display various images by driving the display section by means of various driving circuits arranged at the periphery of the display section. As disclosed in Japanese Patent Application Publication No. Hei7-295521 and the like, the liquid crystal display device is constructed to drive the respective pixels by means of analog signals based on gradation data indicative of gradations of the respective pixels after setting signal lines of the respective pixels to a predetermined potential and charging and discharging their storage capacitors by precharge processing, for example, on a line-by-line basis, and such a constant current circuit is provided in a circuit block or the like associated with driving using the analog signals.

However, TFTs which are active elements applied to this kind of liquid crystal display device have the disadvantage of large variations, and if the constant current circuits shown in FIGS. 1 and 2 are constructed by using transistors which are such active elements, there occurs the problem that the reference currents set by the transistors Q1 and Q4 vary, and in addition, a current which flows into the transistor Q3 and a current which flows out from the transistor Q6 vary with respect to the respective reference currents.

In order to reduce the influences of such variations on individual circuit blocks, heretofore, the design has been to cause comparatively large currents to flow in constant current circuits using this kind of active element. However, this design offers the disadvantage of increasing power consumption by that amount.

DISCLOSURE OF THE INVENTION

The present invention has been made in this regard, and it proposes a constant current circuit capable of reducing variations compared to conventional circuits, and a flat display device using such a constant current circuit.

To solve the above problems, the present invention is applied to a constant current circuit which, after connecting a sampling capacitor connected between a gate and a source of a transistor and a drain of the transistor to a reference current source and setting a voltage across the sampling capacitor to a voltage between the gate and the source produced during the transistor is driven by a reference current of the reference current source, cuts off the connection among the sampling capacitor, the transistor and the reference current source, as well as connects the drain of the transistor to a driving target and drives the driving target by means of a current of the transistor due to the voltage between the gate and the source which is set in the sampling capacitor.

According to the construction of the present invention, the present invention is applied to the constant current circuit which, after connecting the sampling capacitor connected between the gate and the source of the transistor and the drain of the transistor to the reference current source and setting the voltage across the sampling capacitor to the voltage between the gate and the source produced during the transistor is driven by the reference current of the reference current source, cuts off the connection among the sampling capacitor, the transistor and the reference current source, as well as connects the drain of the transistor to the driving target and drives the driving target by means of the current of the transistor due to the voltage between the gate and the source which is set in the sampling capacitor. Accordingly, even if the characteristics of the transistor vary, the transistor can operate and drive the driving target under driving conditions based on the reference current, so that it is possible to markedly reduce a variation of a constant current to be used for driving the driving target.

In addition, the present invention is applied to a flat display device, and a constant current circuit of a buffer circuit provided in a vertical driving circuit, after connecting a sampling capacitor connected between a gate and a source of a transistor and a drain of the transistor to a reference current source and setting a voltage across the sampling capacitor to a voltage between the gate and the source produced during the transistor is driven by a reference current of the reference current source, cuts off the connection among the sampling capacitor, the transistor and the reference current source, as well as connects the drain of the transistor to a driving target and drives the driving target by means of a current of the transistor due to the voltage between the gate and the source which is set in the sampling capacitor.

According to the construction of the present invention, it is possible to provide a flat display device capable of reducing characteristic variations due to the driving of individual signal lines by using constant current circuits whose variations are reduced compared to conventional circuits.

According to the present invention, after a sampling capacitor is charged with a reference current and a gate-source voltage of a transistor due to the reference current is set in the sampling capacitor, the transistor is driven to function as a constant current circuit, by the gate-source voltage of the sampling capacitor, so that it is possible to reduce variations in constant current circuits as compared to conventional circuits.

In addition, since the flat display device is constructed by using such constant current circuits, it is possible to reduce variations due to driving of the individual signal lines, so that it is possible to reduce constant current values due to constant currents and decrease the overall power consumption by that amount.

BEST MODE FOR CARRYING OUT THE INVENTION

Embodiments of the present invention will be described below in detail with reference to the accompanying drawings.

(1) Embodiment 1

(1-1) Construction of Embodiment 1

Figure 3:
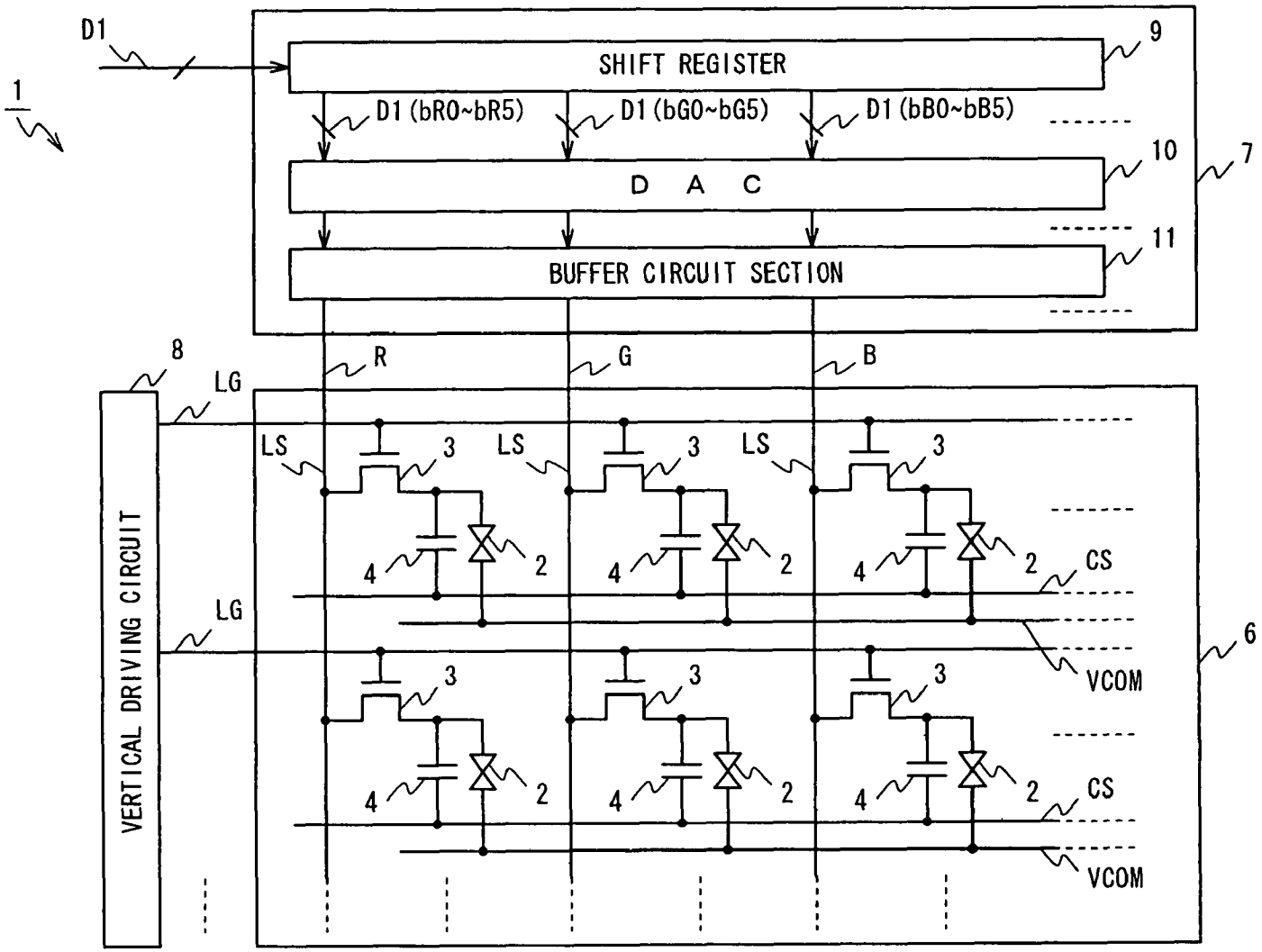
FIG. 3 is a block diagram showing a liquid crystal display device according to Embodiment 1 of the present invention.

FIG. 3 is a block diagram showing a liquid crystal display device according to Embodiment 1 of the present invention. In this liquid crystal display device 1, each pixel is formed by a liquid crystal cell 2, a polysilicon TFT 3 which is a switching device for the liquid crystal cell 2, and a storage capacitor 4, and the pixels are arranged in a matrix form so as to form a display section 6. In the liquid crystal display device 1, the respective pixels which form the display section 6 are connected to a horizontal driving circuit 7 and a vertical driving circuit 8 by signal lines LS and gate lines LG so as to display a desired image by sequentially selecting the pixels by means of the vertical driving circuit 8 and setting the gradation of each of the pixels in accordance with a driving signal from the horizontal driving circuit 7.

Accordingly, the vertical driving circuit 8 sequentially selects the pixels in units of lines in conjunction with processing in the horizontal driving circuit 7 by driving each of the gate lines LG in accordance with a timing signal outputted from a timing generation circuit, which is not shown.

The horizontal driving circuit 7 sequentially cyclically loads gradation data D1 indicative of the gradation of each of the pixels and generates driving signals for the respective signal lines LS. More specifically, in the horizontal driving circuit 7, a shifter register 9 compiles the gradation data D1 in units of lines by sequentially cyclically sampling the gradation data D1, and outputs one line of gradation data D1 to a digital-to-analog conversion circuit (DAC) 10 at a predetermined timing during a horizontal blanking period.

The digital-to-analog conversion circuit 10 performs digital-to-analog conversion of the gradation data D1 outputted from the shifter register 9 to output them. A buffer circuit section 11 drives the signal lines LS in accordance with output signals of the digital-to-analog conversion circuit 10. In this manner, the horizontal driving circuit 7 is able to display a desired image by driving each of the pixels of the display section 6 in accordance with gradation based on the gradation data D1. The buffer circuit section 11 drives the respective signals LS in accordance with the output signals of the digital-to-analog conversion circuit 10, and at this time also drives the signal lines LS to enable so-called precharge processing.

Figure 4:
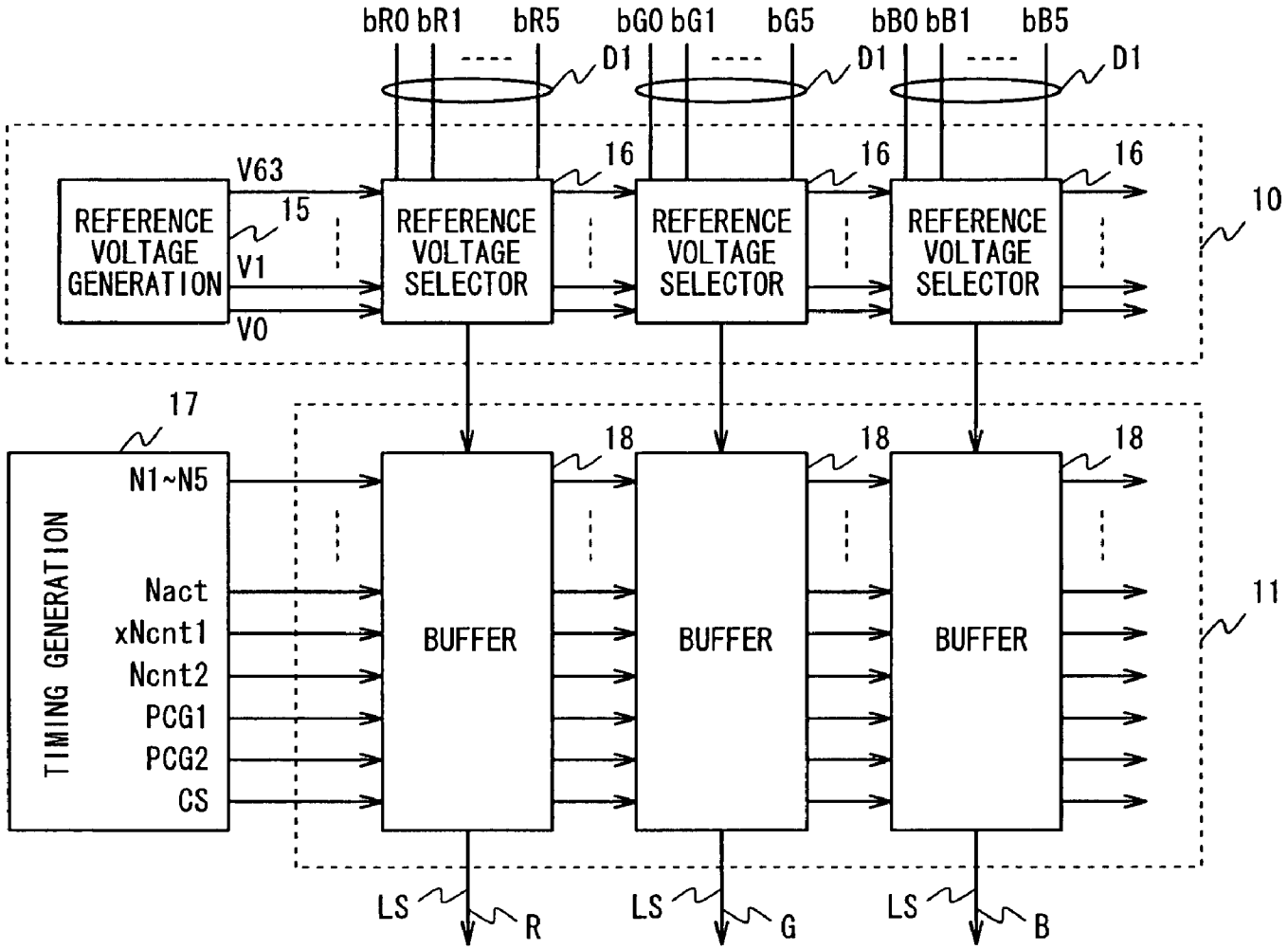
FIG. 4 is a block diagram showing part of a horizontal driving circuit of the liquid crystal display device shown in FIG. 3.

FIG. 4 is a block diagram showing in detail the digital-to-analog conversion circuit 10 and the buffer circuit section 11 of the horizontal driving circuit 7. In the digital-to-analog conversion circuit 10, a reference voltage generation circuit 15 generates and outputs a plurality of reference voltages V0 to V63 by resistively dividing a predetermined generation reference voltage, for example. Reference voltage selectors 16 respectively receive the plurality of reference voltages V0 to V63, and select and output any of the reference voltages in accordance with the gradation data D1 outputted from the shifter register 9. In this manner, the digital-to-analog conversion circuit 10 performs digital-to-analog conversion of the gradation data D1 by the selection of the reference voltages corresponding to the gradation data D1.

The buffer circuit section 11 processes the output signals of the respective reference voltage selectors 16 by means of buffer circuits 18 which operate in accordance with various kinds of timing signals outputted from a timing generation circuit 17, and outputs processed signals to the signal lines LS. In FIG. 4, symbols R, G and B respectively denote systems corresponding to red, green and blue pixels.

Figure 5:
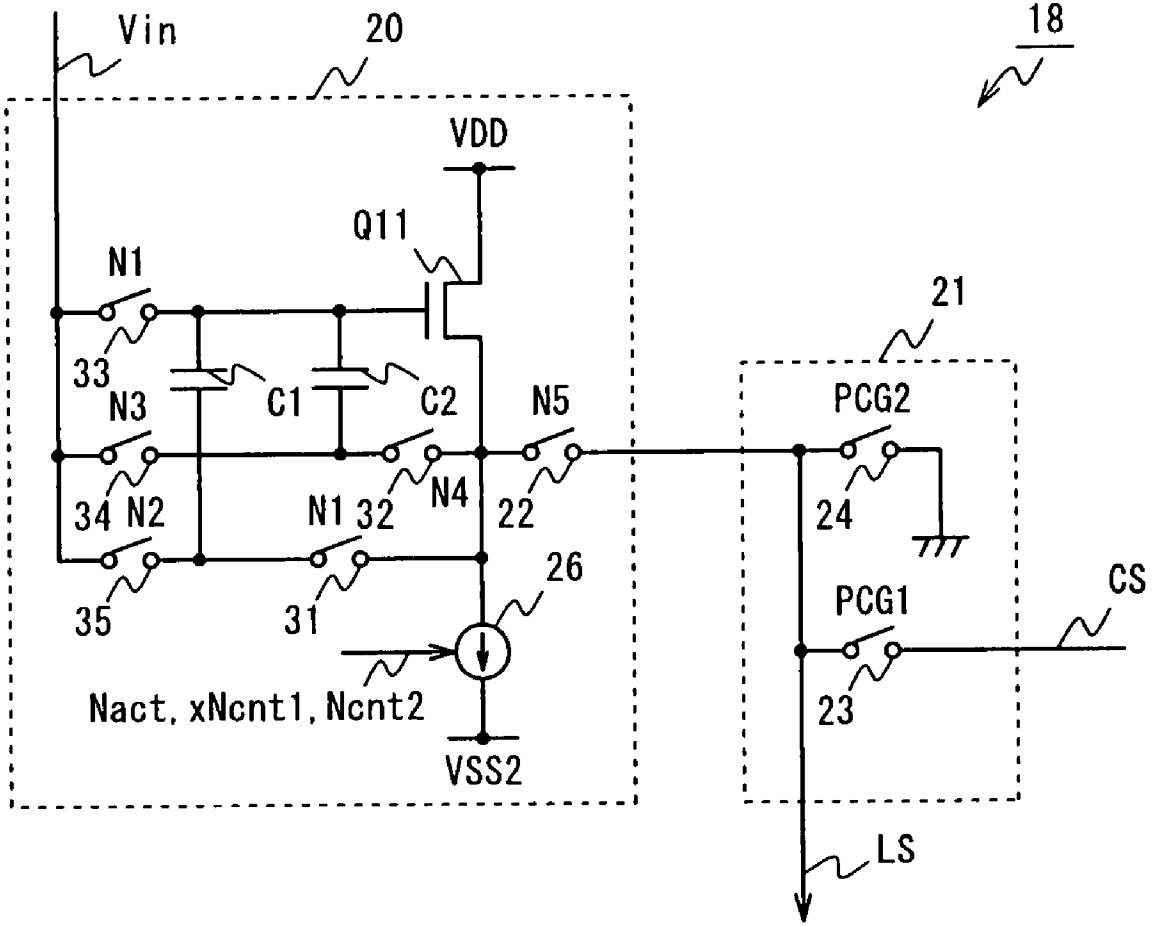
FIG. 5 is a connection diagram showing a buffer circuit shown in FIG. 4.

FIG. 5 is a connection diagram showing in detail the construction of each of the buffer circuits 18. In the buffer circuit 18, the output signal (denoted by symbol Vin) of the reference voltage selector 16 is inputted to an analog buffer circuit 20, and the corresponding signal line LS is driven by the input signal Vin. The buffer circuit 18 also executes precharge processing by switching the potential of the signal line LS together with a CS driving circuit, which is not shown, on a line-by-line basis during the horizontal blanking period. Accordingly, the buffer circuit 18 includes the analog buffer circuit 20, which executes processing for setting the gradation of pixels by the input signal Vin, and a precharge circuit 21 associated with precharge processing. In the following description, each switch circuit is made of a PMOS transistor or an NMOS transistor, and the signs of the timing signals outputted from the timing generation circuit 17 are attached to the respective switch circuits and the like so as to denote timing signals associated with the control of the switch circuits and the like.

Figure 6:
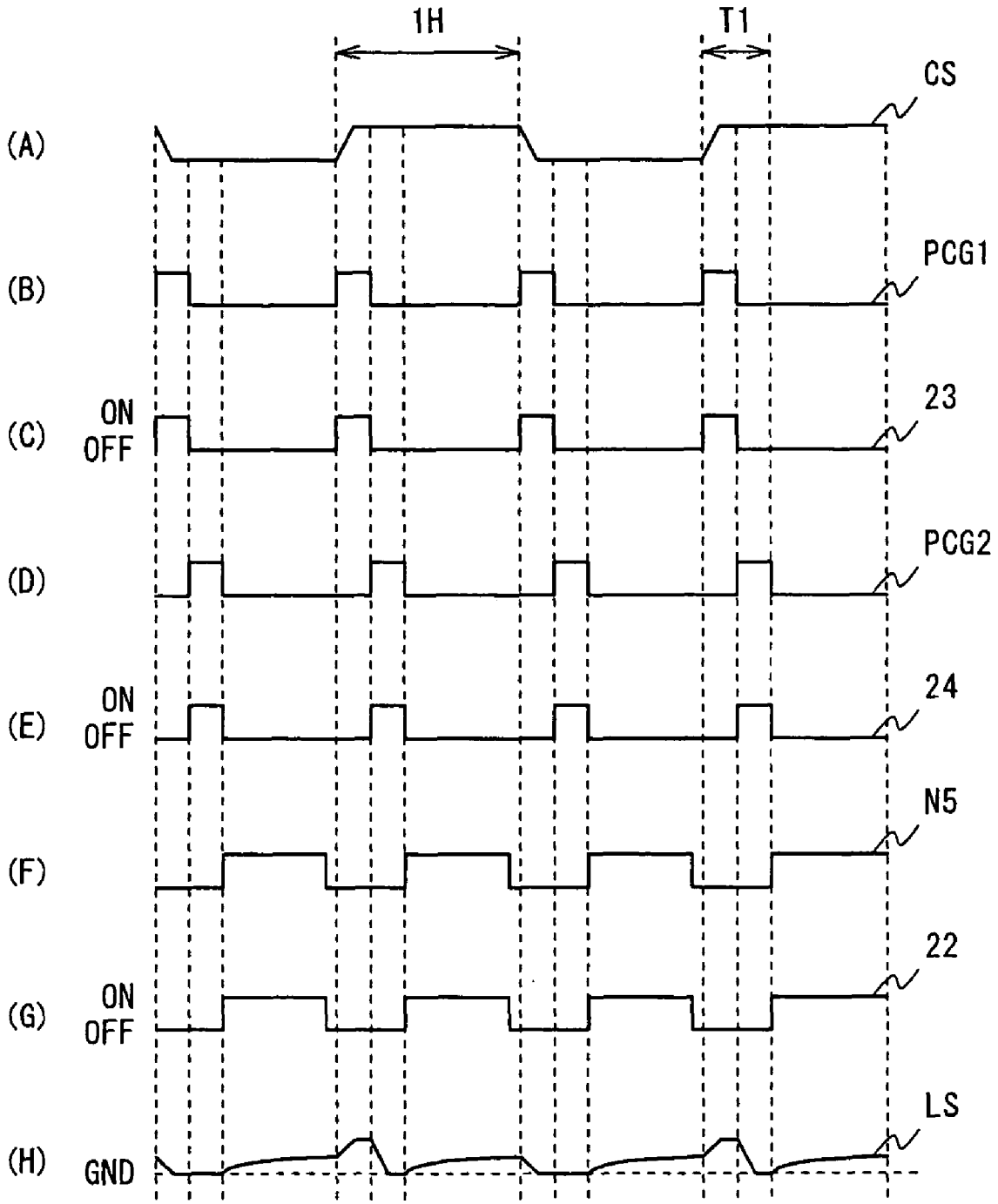
FIG. 6 is a time chart aiding in explaining an operation of a precharge circuit in the buffer circuit shown in FIG. 5.

More specifically, in the liquid crystal display device 1, as shown in FIG. 6, the display section 6 is driven by so-called line inversion, and precharge processing is executed during the horizontal blanking period, and a terminal voltage (refer to FIG. 3; in FIG. 6, represented by the potential of a CS line which is a wiring on this terminal side, as denoted by symbol CS) on the side of the storage capacitor 4 where a transistor 3 is not provided is switched between a ground level and a positive predetermined potential by the CS driving circuit, which is not shown (FIG. 6(A)). Accordingly, the analog buffer circuit 20 is disconnected from the signal line LS by a switch circuit 22 provided on an output stage, during a period (hereinafter referred to as a precharge period) T1 when precharge processing is executed (FIGS. 6(F) and 6(G)).

The precharge circuit 21 sets switch circuits 23 and 24 connected to the signal line LS, to an OFF state and an ON state, respectively, in accordance with timing signals PCG1 and PCG2 outputted from the timing circuit 17 during approximately the first half of the precharge period T1 (FIGS. 6(B) to (E)), thereby connecting the CS line CS to the signal line LS and switching the potential of the CS line CS by means of the CS driving circuit (FIG. 6(H)). Accordingly, the precharge circuit 21 is constructed to effectively use the charges stored in the signal line LS and the storage capacitor 4 to switch the potential of the CS line CS, so as to reduce the overall power consumption by that amount.

Subsequently, the switch circuits 23 and 24 are respectively set to an ON state and an OFF state by the timing signals PCG1 and PCG2 (FIGS. 6(B) to 6(E)), thereby disconnecting the signal line LS from the CS line CS and setting the potential of the signal line LS to the ground level (FIG. 6(H)). Accordingly, in this embodiment, the potential of the CS line CS is switched between the ground level and the positive predetermined potential so that the signal line LS can be driven on the basis of the ground level, and as will be described later, the construction of the analog buffer circuit 20 associated with the driving of the signal line LS can be simplified by that amount.

Figure 7:
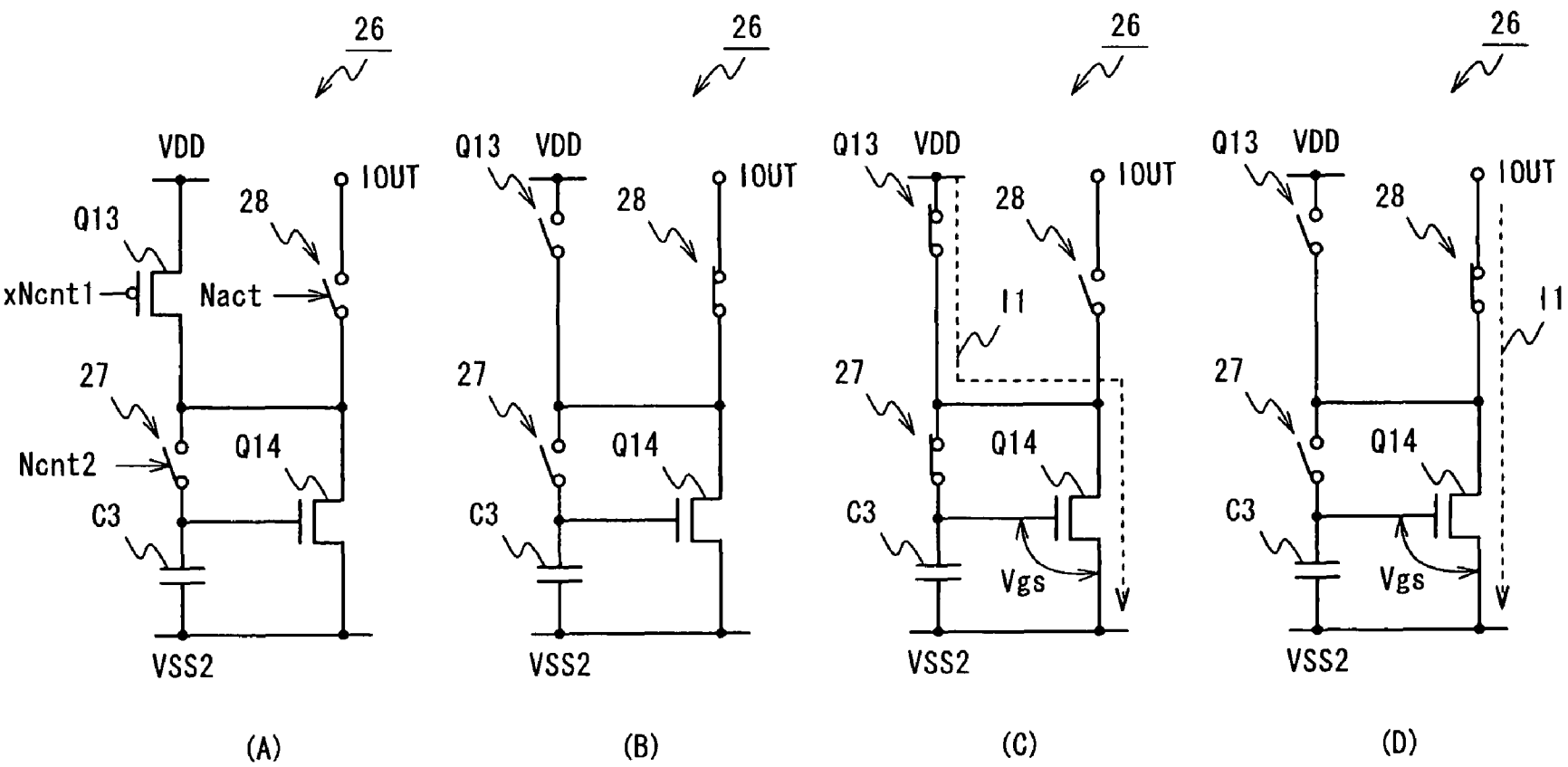
FIG. 7 is a connection diagram showing a constant current circuit applied to the liquid crystal display device shown in FIG. 3.

The analog buffer circuit 20 includes a source follow made of an NMOS transistor Q11, and a constant current circuit 26 shown in FIG. 7(A) is connected to the source of the NMOS transistor Q11. In the constant current circuit 26, a reference current source is formed by a PMOS transistor Q13 to the gate of which a timing signal xNcnt1 is inputted, and an NMOS transistor Q14 is connected in series to the PMOS transistor Q13, and a reference current due to the PMOS transistor Q13 is formed to flow into the NMOS transistor Q14.

In addition, the constant current circuit 26 is constructed so that a sampling capacitor C3 is provided between the gate and the source of the NMOS transistor Q14, and a switch circuit 27 which causes the reference current due to the PMOS transistor Q13 to flow into the sampling capacitor C3 is provided. In the constant current circuit 26, the switch circuit 27 is turned on by a predetermined timing signal Ncnt2, and a gate-source voltage Vgs of the NMOS transistor Q14 which is in the state of causing the reference voltage by the PMOS transistor Q13 to flow into the NMOS transistor Q14 is sampled into the sampling capacitor C3. After that, the switch circuit 27 is switched to an OFF state and holds the gate-source voltage Vgs sampled in the sampling capacitor C3.

In the constant current circuit 26, the drain of the NMOS transistor Q14 is connected via a switch circuit 28 to the source of the NMOS transistor Q11 which constitutes a buffer circuit, and the switch circuit 23 is set to be switched to an ON state in accordance with a predetermined timing signal Nact after the gate-source voltage Vgs of the NMOS transistor Q14 has been sampled by the sampling capacitor C3 and the reference current has been stopped from being outputted from the PMOS transistor Q13, by the timing signal xNcnt1, so that a current due to the gate-source voltage Vgs sampled by the sampling capacitor C3 is caused to flow out by the transistor Q11.

Figure 8:
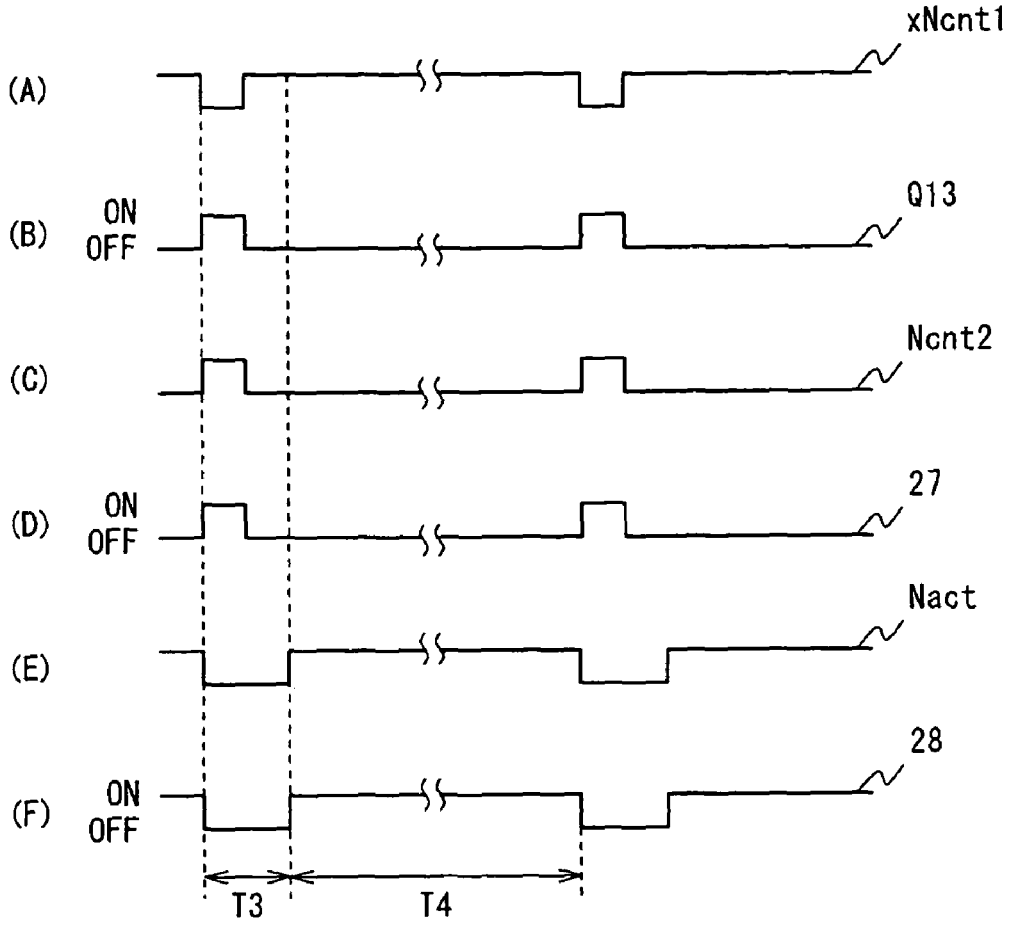
FIG. 8 is a time chart aiding in explaining the operation of the constant current circuit shown in FIG. 7.

FIG. 8 is a time chart showing the transition of each of the timing signals xNcnt1, Nact and Ncnt2 as well as the transition of each of the switch circuits 27 and 28 and the transistor Q13. When the constant current circuit 26 is in an initial state, i.e., immediately after the constant current circuit 26 starts operation, as shown in FIG. 7(B), the timing signal xNcnt1 is held at an L level and the transistor Q13 is held at an OFF state (FIGS. 8(A) and 8(B)), and the timing signals Nact and Ncnt2 are respectively held at an H level and an L level, so that the switch circuits 27 and 28 are respectively held at an OFF state and an ON state (FIGS. 8(C) to 8(F)). Accordingly, in this case, the constant current circuit 26 is held in the state of inhibiting the transistor Q11 from discharging any current.

The respective logical values of the timing signals xNcnt1, Nact and Ncnt2 are simultaneously switched at a predetermined timing, so that, as shown in FIG. 7(C), the switch circuits 27 and 28 of the constant current circuit 26 are respectively switched to the ON state and the OFF state, while the transistor Q13 starts operating to start outputting a reference current. Accordingly, in the constant current circuit 26, a reference current I1 due to the transistor Q13 charges the sampling capacitor C3, and flows out via the NMOS transistor Q14. The charge current of the sampling capacitor C3 gradually decreases as the voltage across the sampling capacitor C3 rises due to charging, and when the charge current reaches the gate-source voltage Vgs of the transistor Q14 that is required to cause the reference current I1 to flow out from the transistor Q14, the charge current stops flowing into the sampling capacitor C3, and in this state, all the reference current I1 due to the transistor Q13 flows into the transistor Q14. Accordingly, in the constant current circuit 26, the gate-source voltage Vgs of the transistor Q14 that is required to cause the reference current I1 to flow into the transistor Q14 is set in the sampling capacitor C3 by charging the sampling capacitor C3 connected between the gate and the source of the transistor Q14 by means of the reference current I1 while causing the reference current I1 to flow into the transistor Q14.

When the constant current circuit 26 switches the respective logical values of the timing signals xNcnt1, Nact and Ncnt2 and a period sufficient to hold the gate-source voltage Vgs of the transistor Q14 in the sampling capacitor C3 elapses, the respective timing signals Nact and Ncnt2 return to the original logical values, so that the supply of the reference current I1 is stopped and the sampling capacitor C3 is disconnected from the drain of the transistor Q14. Subsequently, the timing signal xNcnt1 returns to the original logical value, and the drain of the transistor Q14 is connected to the transistor Q11 which is a driving target of the constant current circuit 26. Accordingly, the constant current circuit 26, as shown in FIG. 7(D), is adapted to function as a constant current circuit to cause a current to flow out from the transistor Q11 by means of the gate-source voltage Vgs of the transistor Q14 due to the reference current I1 which is set in the sampling capacitor C3.

Accordingly, as mentioned above in connection with FIG. 6, in the liquid crystal display device 1, the precharge processing is executed from the precharge period T1 provided in the horizontal blanking period so that a period T3 for setting in the sampling capacitor C3 the gate-source voltage Vgs of the transistor Q14 due to the reference current I1 required to cause the constant current circuit 26 to function as a constant current circuit is allocated to the precharge period T1, and the respective timing signals xNcnt1, Nact and Ncnt2 are supplied so that the constant current circuit 26 operates while repeating the period T3 for setting the gate-source voltage Vgs and a period T4 for causing the constant current circuit 26 to function as a constant current circuit.

The analog buffer circuit 20 (FIG. 5) has capacitors C1 and C2 respectively provided with switching circuits 31 and 32 on their source sides, between the gate and the source of the transistor Q11. Switch circuits 33, 34 and 35 are respectively provided on the side where the gate of the transistor Q11 is located, on the sides where the switching circuits 31 and 32 for the capacitor C1 are located on the side where the capacitor C2 is located, and a signal Vin from the reference voltage selector 16 is inputted to the other end of each of the switch circuits 33, 34 and 35. The analog buffer circuit 20 is adapted to cancel the variations of the transistor Q11 by switching the switch circuits 31 to 35 and drive the signal line LS in accordance with the input signal Vin.

Figure 9:
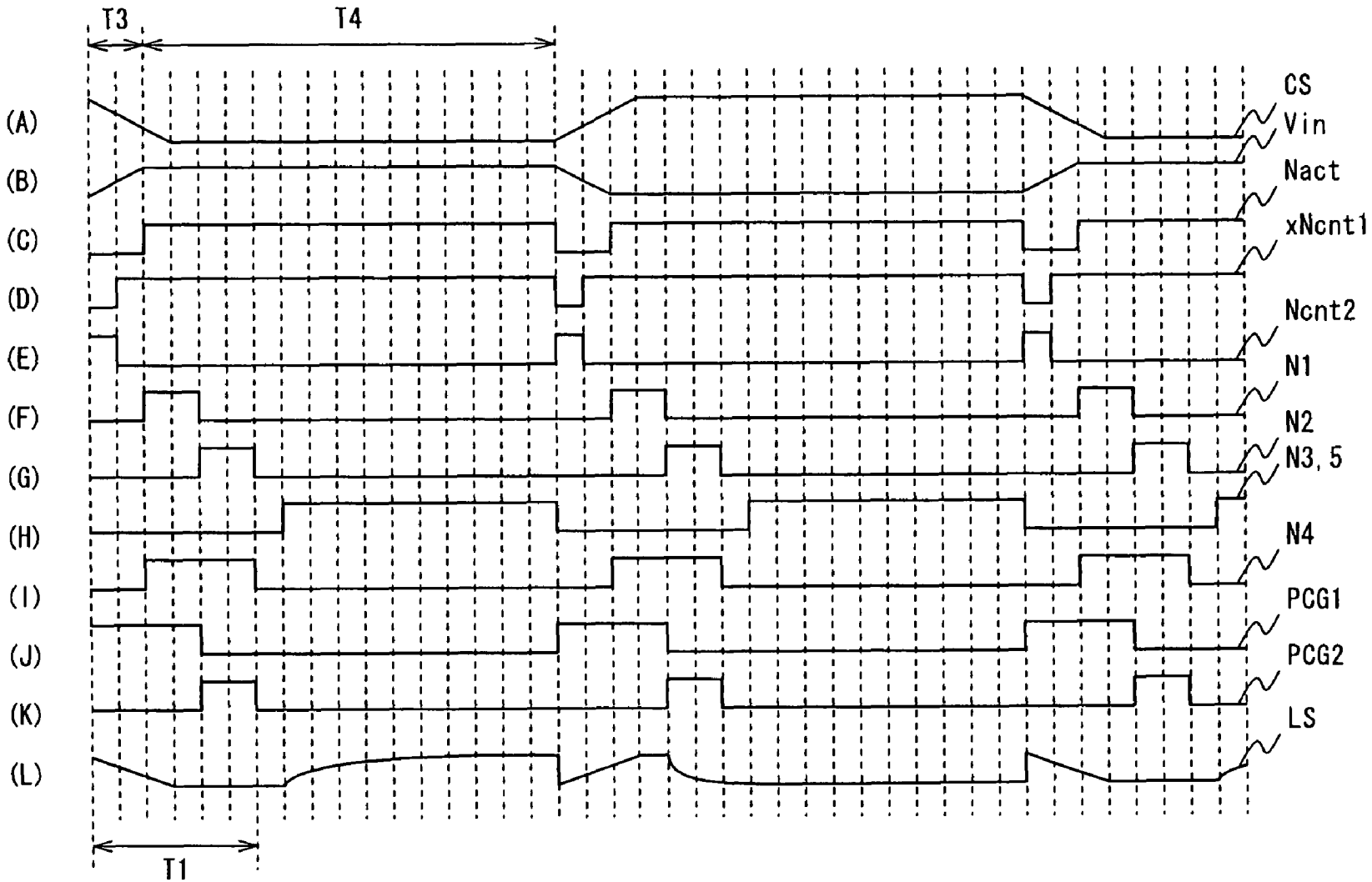
FIG. 9 is a time chart aiding in explaining an operation of an analog buffer circuit in the buffer circuit shown in FIG. 5.

More specifically, from the contrast between the processing associated with precharge and the processing associated with the constant current circuit 26, mentioned above in connection with FIGS. 6 and 8, in the buffer circuit 18, as shown in FIG. 9, sampling processing associated with the transistor Q13 is started in the constant current circuit 26 (FIGS. 9(C) to 9(E)) in accordance with the start of the precharge period T1 in the precharge circuit 21 (FIGS. 9(A), 9(J) to 9(L)). In the analog buffer circuit 20, when this processing is started, all the switch circuits 22 and 31 to 35 are set to OFF states.

Figure 10:
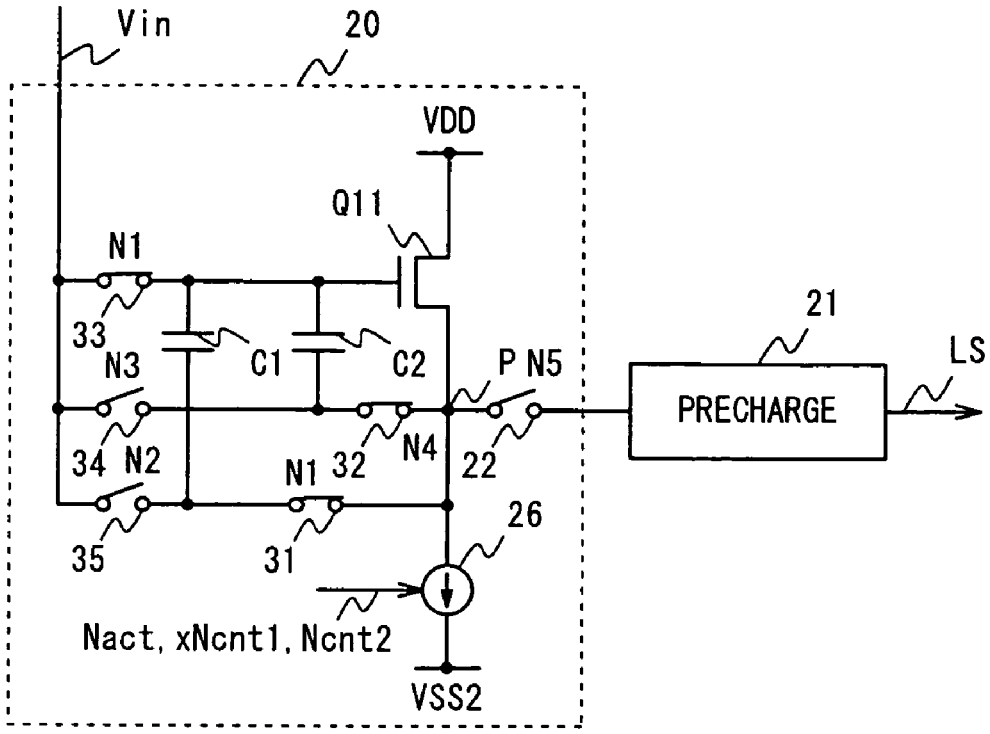
FIG. 10 is a connection diagram aiding in explaining the operation of the analog buffer circuit in the buffer circuit shown in FIG. 5.

After that, when the period T3 elapses and the constant current circuit 26 starts to function as a constant current circuit, the switch circuits 31, 32 and 33 are switched to ON states as shown in FIG. 10. In FIG. 9, the rises of timing signals N1 to N5 for controlling the respective switches 22 and 31 to 35 represent ON states. Accordingly, the analog buffer circuit 20 is adapted to sample a gate-source voltage VosA of the transistor Q11 placed in this state by means of the capacitors C1 and C2 and detect an offset during operation by a source follower.

Figure 11:
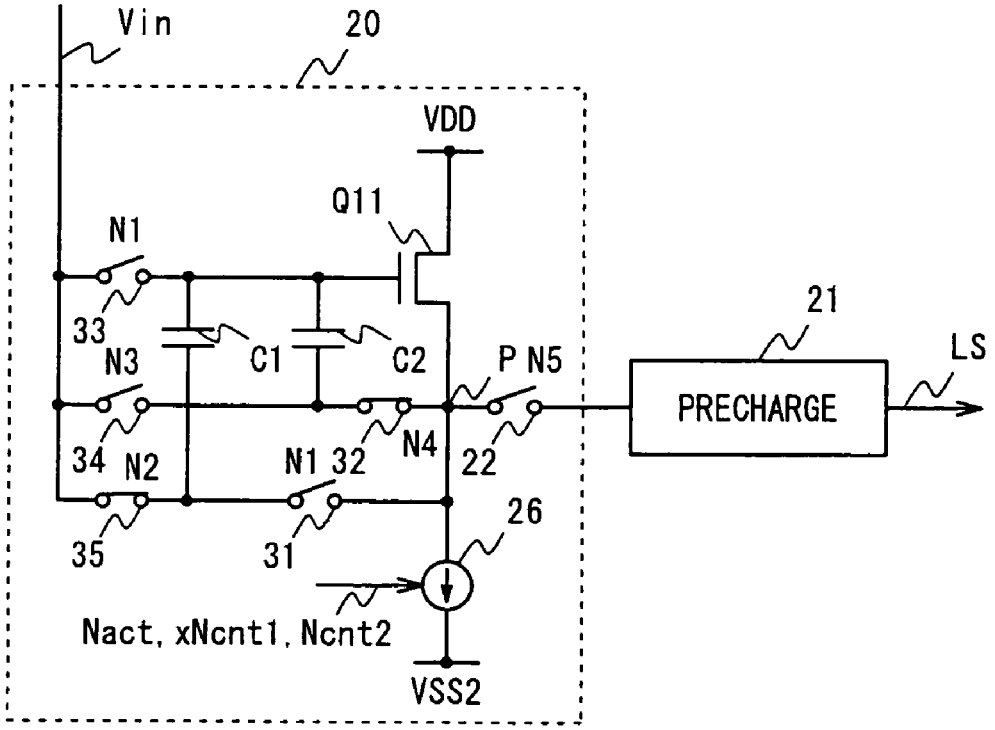
FIG. 11 is a connection diagram used in a continued explanation of FIG. 10.

Subsequently, as shown in FIG. 11, the switch circuits 31 and 33 are switched to the OFF states, and the switch circuit 35 is switched to the ON state. Accordingly, in the analog buffer circuit 20, the transistor Q11 operates by a current due to the constant current circuit 26 with the gate voltage of the transistor Q11 being offset with respect to the input voltage Vin by the amount of the voltage VosA sampled in the capacitor C1, and a gate-source voltage VosB of the transistor Q11 placed in this state is sampled by C2. Accordingly, the source voltage of the transistor Q11 becomes Vin+(VosA−VosB). Accordingly, the analog buffer circuit 20 is adapted to further detect an offset during operation by the source follower in the state of canceling the offset voltage detected previously in the capacitor C1.

Figure 12:
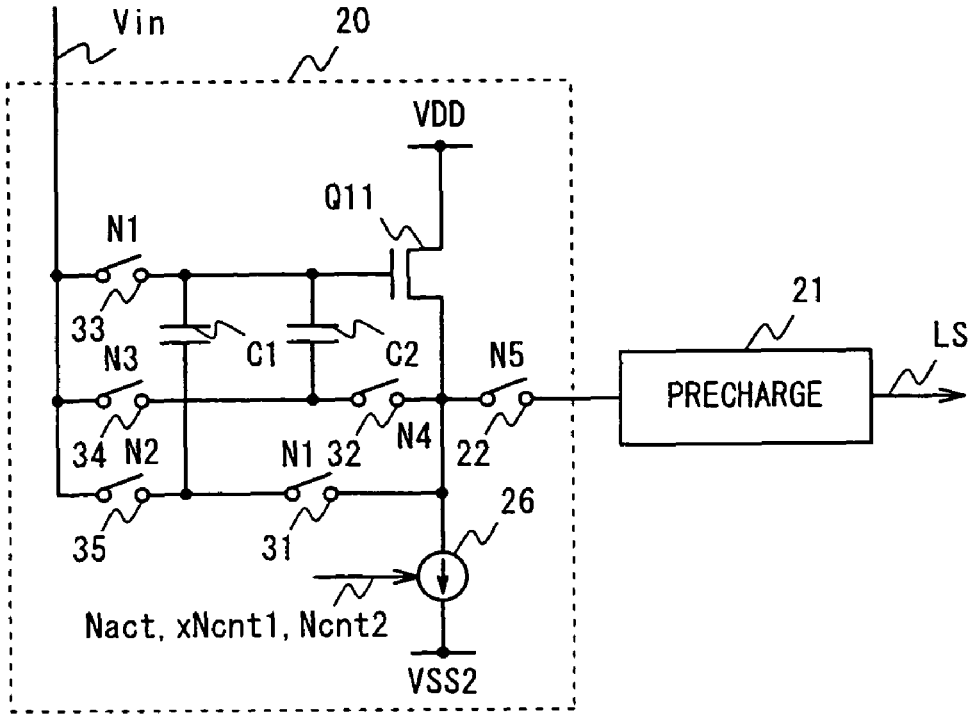
FIG. 12 is a connection diagram used in a continued explanation of FIG. 11.
Figure 13:
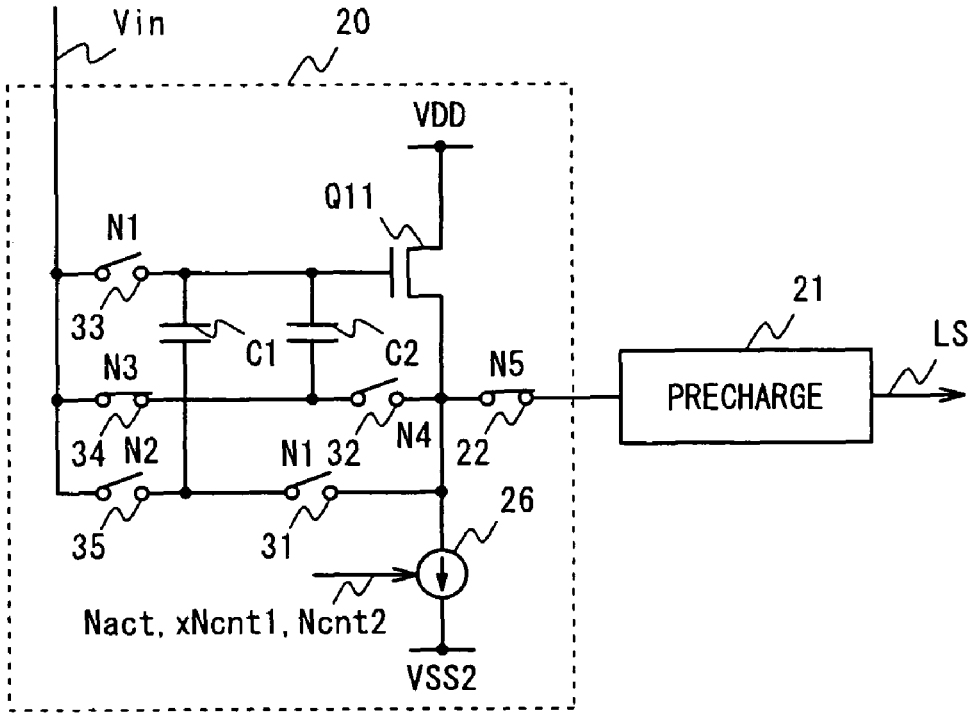
FIG. 13 is a connection diagram used in a continued explanation of FIG. 12.

Subsequently, in the analog buffer circuit 20, after all the switch circuits 22 and 31 to 35 have been switched to the OFF states as shown in FIG. 12, the switch circuits 22 and 34 are set to the ON states as shown in FIG. 13. Accordingly, the analog buffer circuit 20 is adapted to offset the input voltage Vin by the offset voltage detected in the capacitor C2 and drive the signal line LS by the source follower, and to repeat offset detection twice to reduce an offset voltage relative to the input voltage Vin by that amount with high accuracy and drive the signal line LS, thereby sufficiently reducing the influence of the variations of the transistor Q11.

In this manner, in the state shown in FIG. 13, the analog buffer circuit 20 outputs a source current from the transistor Q11 to the constant current circuit 26 and the signal line LS, and charges the storage capacitor 4 with the output of the source current. In addition, as the source potential rises due to the charging of the storage capacitor 4, the analog buffer circuit 20 gradually decreases the source current output from the transistor Q11, and when the source potential becomes equal to the input voltage Vin, the analog buffer circuit 20 stops outputting the source current to the signal line LS and outputs the source current to only the constant current circuit 26, thereby driving the corresponding signal line LS in accordance with the input voltage Vin.

The analog buffer circuit 20 is adapted so that the period during which the signal line LS is to be driven by means of the state shown in FIG. 13 is set to a period following the precharge period T1.

(1-2) Operation of Embodiment 1

According to the above-described construction, in the liquid crystal display device 1 (FIG. 3), the gradation data D1 indicating the gradation of each pixel is inputted in a raster scan order from a controller associated with drawing or the like, and the gradation data D1 are grouped in units of lines by being sequentially sampled by the shifter register 9 of the horizontal driving circuit 7 and transferred to the digital-to-analog conversion circuit 10. The gradation data D1 are converted to analog signals in the digital-to-analog conversion circuit 10, and the respective signal lines LS of the display section 6 are driven by the analog signals. Accordingly, in the liquid crystal display device 1, the individual pixels of the display section 6 which are sequentially selected by the control of the gate lines LG by the vertical driving circuit 8 are driven by the horizontal driving circuit 7, so that an image due to the gradation data D1 is displayed on the display section 6.

In this manner, in the horizontal driving circuit 7 (FIG. 4) which drives the signal lines LS of the display section 6, the reference signals V0 to V63 corresponding to the individual gradation levels of the gradation data D1 are generated by the reference voltage generation circuit 15, and in the reference voltage selectors 16, the gradation data D1 are subjected to digital-to-analog conversion processing by selecting the reference signals V0 to V63 in accordance with the gradation data D1, and the result of the digital-to-analog conversion processing is inputted to the buffer circuits 18, so that each of the signal lines LS is driven.

In each of the buffer circuits 18 (FIGS. 5 and 6), during the horizontal blanking period, the analog buffer circuit 20 is disconnected from the signal line LS, and the CS line CS is set to the positive predetermined potential or the ground potential at intervals of a horizontal scanning period with the CS line CS located on the side of the storage capacitor 4 opposite to the transistor 3 being connected to the signal lines LS by the setting of the switch circuit 23. In addition, after that, the CS line CS is disconnected from the signal line LS, and the signal line LS is held at the ground potential by the setting of the switch circuit 24.

More specifically, in a predetermined line selected by one of the gate lines LG at a predetermined timing, the CS line CS and the signal lines LS are connected to one another, and the both-ends electrodes of each of the storage capacitors 4 associated with the predetermined line are set to the ground level, and subsequently, these signal lines LS are set to the ground level and are driven by analog signals outputted from the reference voltage selectors 16. In the subsequent line, after the potential across the storage capacitor 4 has been set to the positive predetermined potential, the signal lines LS are set to the ground level and are driven by analog signals outputted from the reference voltage selectors 16. Accordingly, in the liquid crystal display device 1, the precharge processing due to driving based on so-called line inversion is executed, so that degradation of the liquid crystal cells 2 is prevented.

Accordingly, in this manner, the CS lines CS are connected to the signal lines LS and the signal lines LS are alternately set to the positive predetermined potential or the ground potential at intervals of a horizontal scanning period, and after that, the signal lines LS are set to the ground potential, so that the liquid crystal display device 1 is adapted to drive each pixel by means of only one power source side based on the ground potential, and the construction of each of the analog buffer circuits 20 is simplified by that amount. More specifically, according to such construction, in each of the analog buffer circuits 20, the signal lines LS need only to be driven between the ground potential and the positive predetermined potential, and each of the analog buffer circuits 20 is constructed with an NMOS source follower circuit construction, so that a construction associated with a negative power source side from the ground potential can be omitted.

Accordingly, in the liquid crystal display device 1, a peripheral construction of the display section 6 can be simplified to realize a far narrower frame and a reduction in power consumption by that amount.

Then, when the precharge processing is completed in this manner, in the liquid crystal display device 1, the corresponding ones of the signal lines LS are driven by the analog buffer circuits 20 and the gradations of pixels corresponding to gradations corresponding to the gradation data D1 are set.

During the driving of the signal lines LS, in each of the analog buffer circuits 20 (FIGS. 9 to 13), the processing of correcting an offset during the period of the precharge processing is executed, and the offset is corrected by this processing and the signal lines LS are driven. More specifically, in the analog buffer circuit 20 (FIGS. 9 and 10), first, the capacitors C1 and C2 are arranged in parallel between the gate and the source of the transistor Q11 by the settings of the switch circuits 31 and 32 with the transistor Q11 driven by a constant current due to the constant current circuit 26, and during this state, the digital-to-analog conversion circuit output Vin is supplied to the transistor Q11, so that the gate-source voltage of the transistor Q11 associated with this driving is set in each of the capacitors C1 and C2.

In addition, the digital-to-analog conversion circuit output Vin is supplied to the gate of the transistor Q11 via the capacitor C2 which holds the gate-source voltage in the above-mentioned manner, by the settings of the switch circuits 31, 33 and 35, so that the gate-source voltage of the transistor Q11 based on the state in which an offset is cancelled by the voltage held in the capacitor C2 is set in the capacitor C1.

In the analog buffer circuit 20 (FIGS. 12 and 13), when the precharge processing is completed, the digital-to-analog conversion circuit output Vin is offset by the voltage held in the capacitor C1 in the above-mentioned manner and is supplied to the gate of the transistor Q11, so that each of the signal lines LS can be driven while the influence of the variations of the transistor Q11 is being sufficiently suppressed.

Accordingly, in the liquid crystal display device 1, the analog buffer circuit 20 is constructed with a simple construction based on the NMOS source follower circuit, so that a narrow frame can be realized and power consumption can be reduced by that amount.

When the signal lines LS are to be driven in the above-mentioned manner, in the constant current circuit 26 of the analog buffer circuit 20 (FIG. 7), during a period which is a period of precharge and a starting period of operation of the analog buffer circuit 20, the sampling capacitor C3 connected between the gate and the source of the transistor Q14 and the drain of the transistor Q14 are connected to the reference current source Q13, and after the voltage across the sampling capacitor C3 has been set as the gate-source voltage produced when the transistor Q14 is driven by the reference current I1, the connection among the sampling capacitor C3, the transistor Q14 and the reference current source Q13 is cut off and the drain of the transistor Q14 is connected to a driving target, so that the driving target is driven with the current of the transistor Q14 due to the gate-source voltage set in the sampling capacitor C3.

Figure 1:
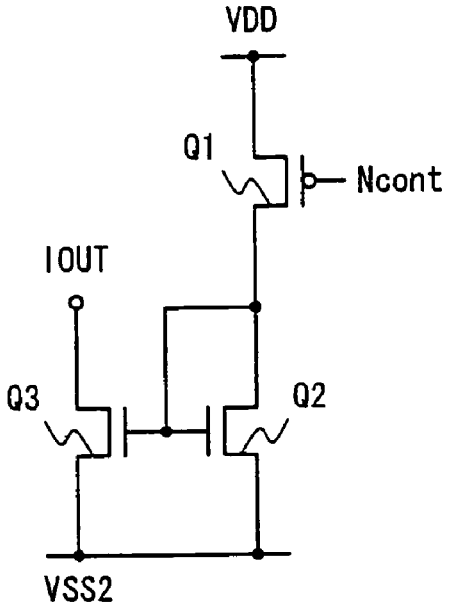
Fig.1 PRIOR ART
FIG. 1 is a connection diagram showing a conventional constant current circuit.
Figure 2:
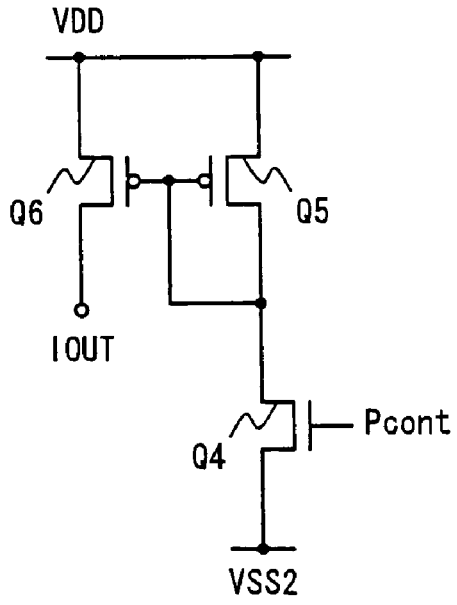
Fig.2 PRIOR ART
FIG. 2 is a connection diagram showing an example different from that shown in FIG. 1.

Accordingly, even if the characteristics of the transistors Q14 vary, the constant current circuit 26 can drive the driving target by means of the reference current I1 without being influenced by such variations. In the respective constant current circuits having the constructions shown in FIGS. 1 and 2, their output currents vary due to the variations of the transistors Q1 to Q3 and Q4 to Q6, whereas in the constant current circuit 26, only the variations of the transistor Q13 which is a reference current source have an influence on the output current, so that the variations of the output current can be reduced to ⅓ as compared to each of the constructions shown in FIGS. 1 and 2.

In addition, since it is possible to avoid settings which increase reference current values in order to reduce the variations, it is also possible to reduce the overall power consumption by that amount.

(1-3) Advantage of Embodiment 1

According to the above-mentioned construction, after a sampling capacitor is charged with a reference current and the gate-source voltage of a transistor due to the reference current is set in the sampling capacitor, the transistor is driven by the voltage of the sampling capacitor so as to function as a constant current circuit, so that variations can be reduced compared to conventional constructions.

In addition, by repeating the processing associated with the sampling and processing which functions as the constant current circuit, it is possible to effectively avoid variations in output current due to voltage variations held in the sampling capacitor.

In addition, the above-mentioned construction is applied to a liquid crystal display, which is a flat display device, so that processing associated with voltage setting for the sampling capacitor is set in a period of precharge so as to set the voltage of the sampling capacitor and execute the processing associated with the constant current circuit, whereby it is possible to prevent the processing associated with voltage setting for the sampling capacitor from influencing the processing of any other circuit block.

(2) Embodiment 2

Figure 14:
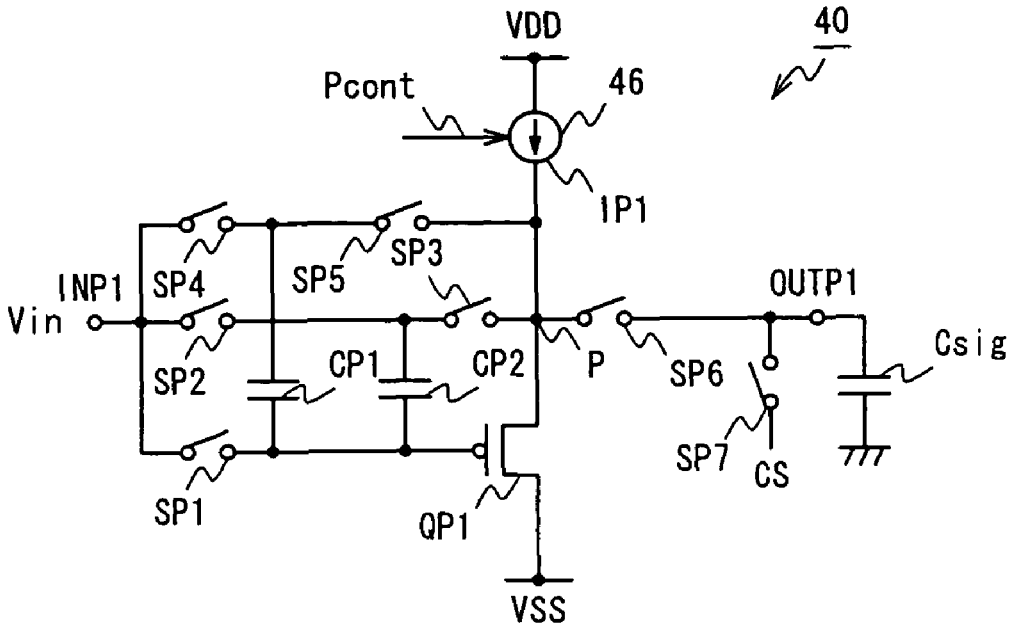
FIG. 14 is a connection diagram showing an analog buffer circuit applied to Embodiment 2 of the present invention.

FIG. 14 is a block diagram showing the construction of an analog buffer circuit which is applied to a liquid crystal display according to Embodiment 2 of the present invention. An analog buffer circuit 40 is constructed with a PMOS source follower circuit in place of an analog buffer which is based on the NMOS source follower circuit according to Embodiment 1. Accordingly, in the liquid crystal display according to Embodiment 2, precharge processing associated with switching between ground potential and negative predetermined potential is executed in place of the precharge processing associated with the switching between the ground potential and the positive predetermined potential in the liquid crystal display device 1 according to Embodiment 1.

Figure 15:
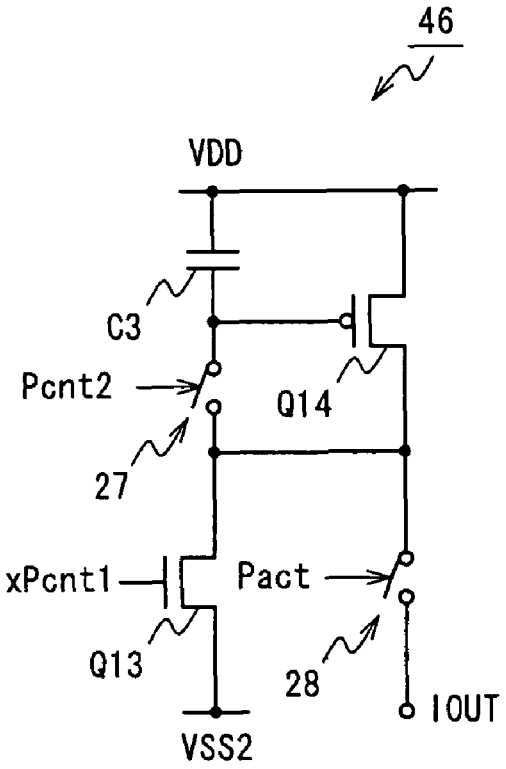
FIG. 15 is a connection diagram showing a constant current circuit applied to the analog buffer circuit shown in FIG. 14.

The analog buffer circuit 40 is constructed in the same manner as the analog buffer circuit 20 of Embodiment 1, except for its construction in which PMOS transistors are used in place of NMOS transistors, and except that the connection among individual sections associated with a positive power source and a negative power source differs according to the construction. In addition, as shown in FIG. 15, a constant current circuit 46 is also constructed in the same manner as the constant current circuit 26 of Embodiment 1, except for its construction in which PMOS transistors are used in place of NMOS transistors, and except that the connection among individual sections associated with the positive power source and the negative power source differs according to the construction.

Figure 16:
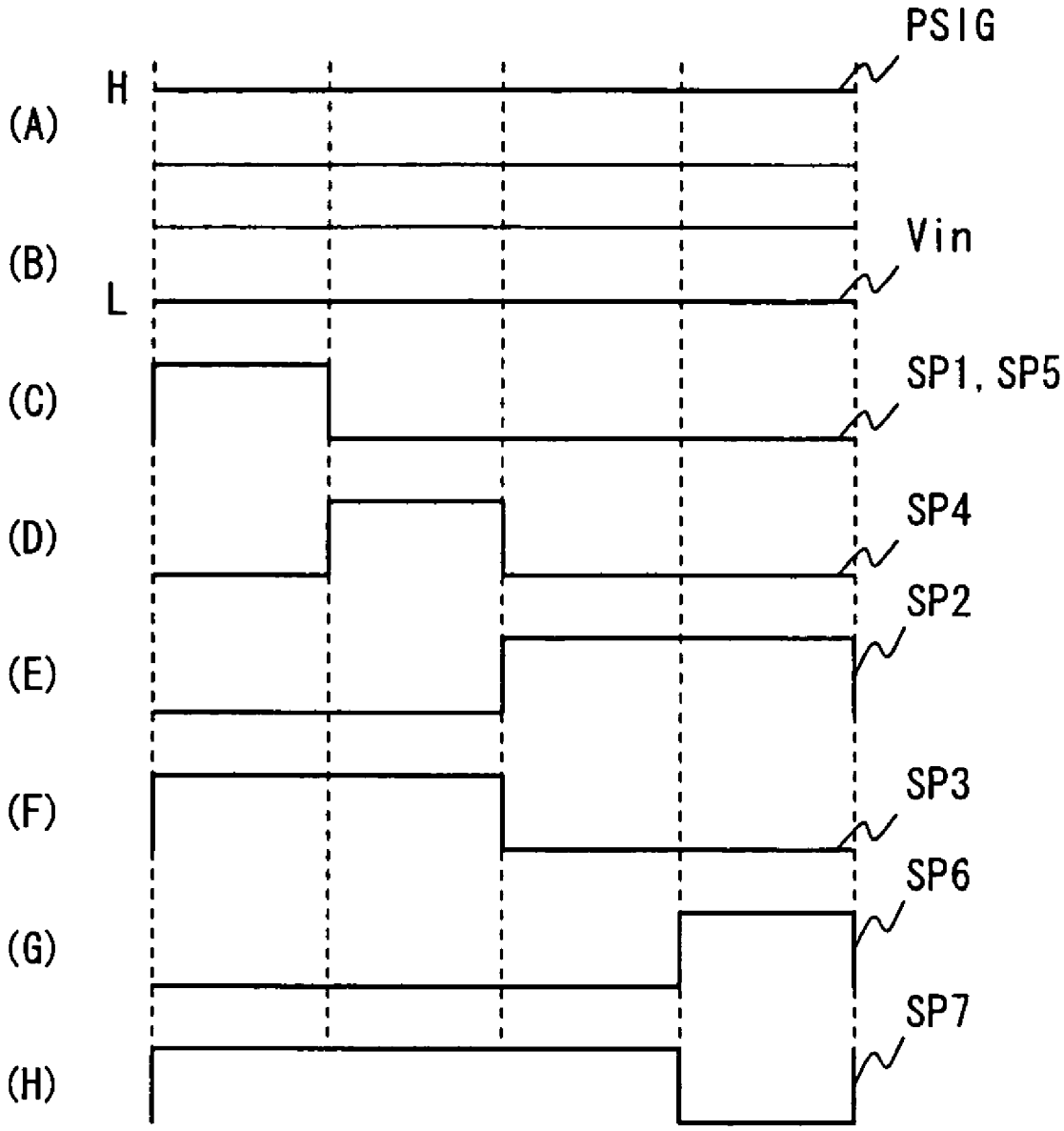
FIG. 16 is a time chart aiding in explaining an operation of the analog buffer circuit shown in FIG. 14.

A time chart associated with the analog buffer circuit is shown in FIG. 16 comparatively with FIG. 9. In FIG. 14, an illustration of a precharge circuit is omitted, and connections associated with a storage capacitor and the like are denoted by a symbol Csig and the like.

Even in the case where the constant current circuit is constructed with a PMOS as in this embodiment, it is possible to obtain the same advantage as Embodiment 1.

(3) Embodiment 3

Figure 17:
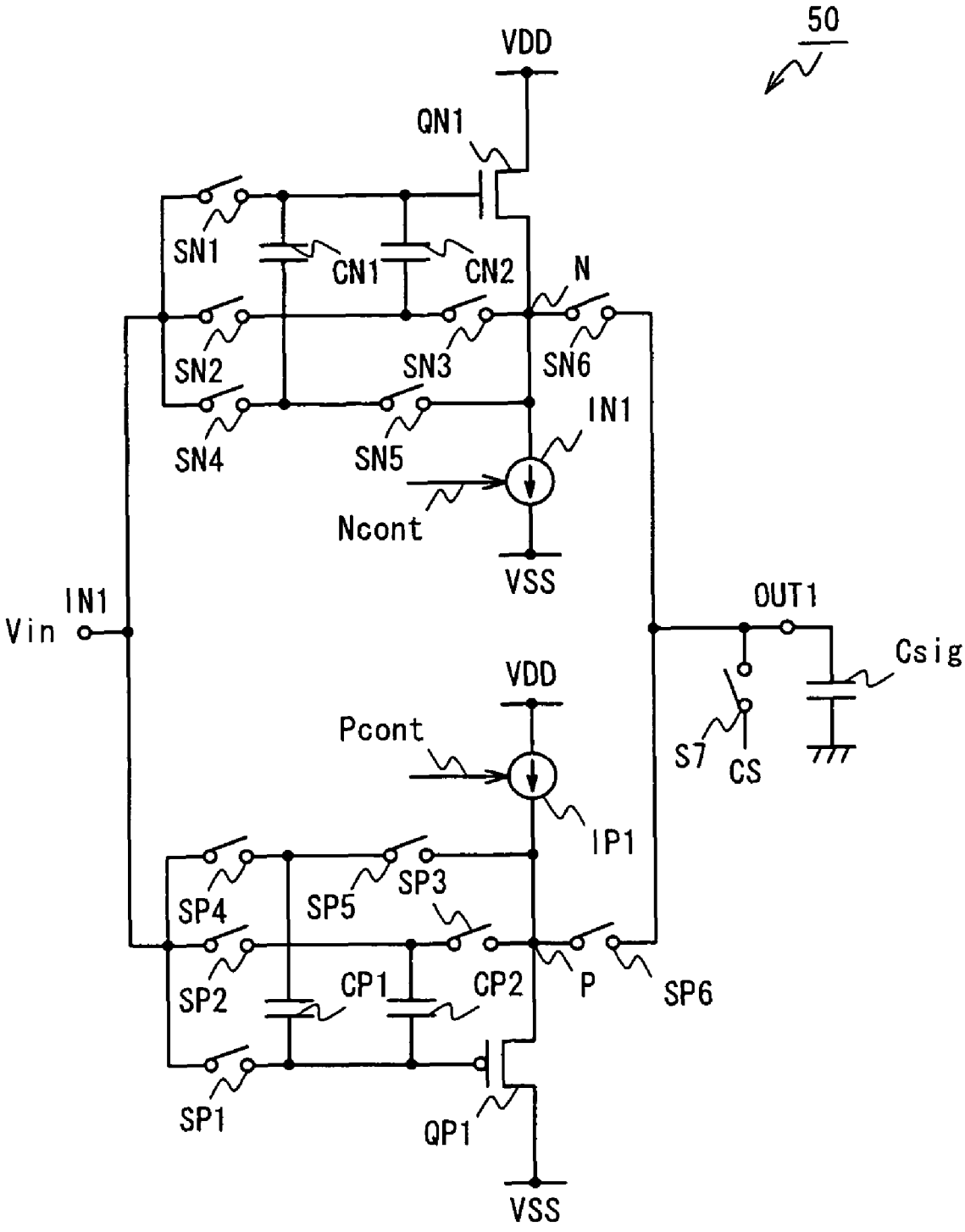
FIG. 17 is a connection diagram showing an analog buffer circuit applied to Embodiment 3 of the present invention.

FIG. 17 is a block diagram showing the construction of an analog buffer circuit which is applied to a liquid crystal display according to Embodiment 3 of the present invention. An analog buffer circuit 50 is constructed with a combination of an NMOS source follower circuit and a PMOS source follower circuit in place of the analog buffer based on the NMOS source follower circuit according to Embodiment 1. Accordingly, in the liquid crystal display according to Embodiment 3, precharge processing associated with switching between ground potential and negative predetermined potential is executed in place of the precharge processing associated with the switching between the ground potential and the positive predetermined potential in the liquid crystal display device 1 according to Embodiment 1.

Figure 18:
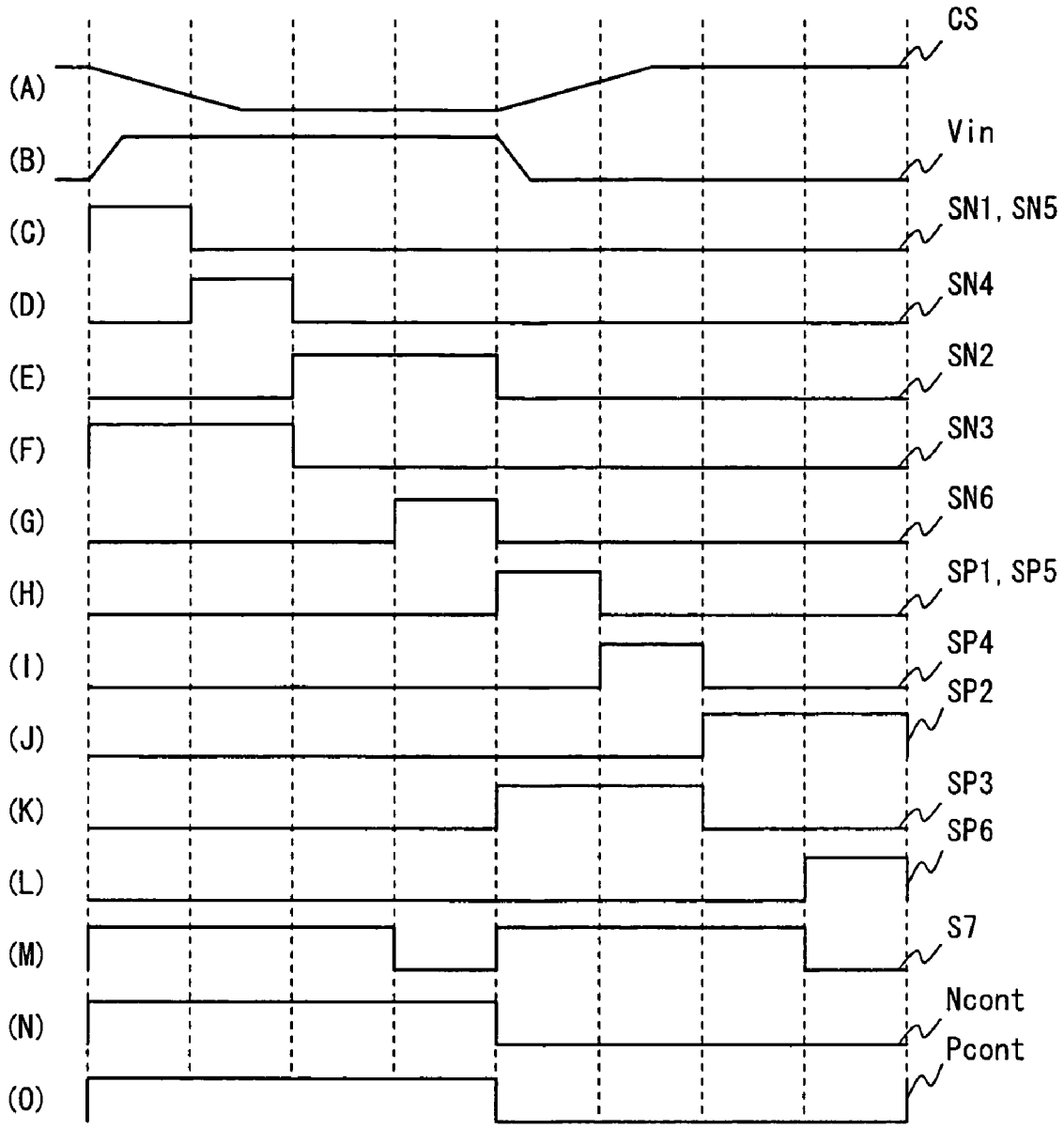
FIG. 18 is a time chart aiding in explaining an operation of the analog buffer circuit shown in FIG. 17.

As shown in FIG. 18, this analog buffer circuit is constructed with a combination of a source follower circuit using NMOS transistors according to Embodiment 1 and a source follower circuit using PMOS transistors according to Embodiment 2, and it is constructed so that the source follower circuits using the NMOS transistors and the source follower circuits using the PMOS transistors alternately operate in accordance with settings of the positive or negative side of the potential associated with precharge processing.

Even in the case where the analog buffer circuit is constructed with the combination of the NMOS source follower circuit and the PMOS source follower circuit as in this embodiment, it is possible to obtain an advantage similar to that of the first or second embodiment in terms of the constant current circuit.

(4) Embodiment 4

Figure 19:
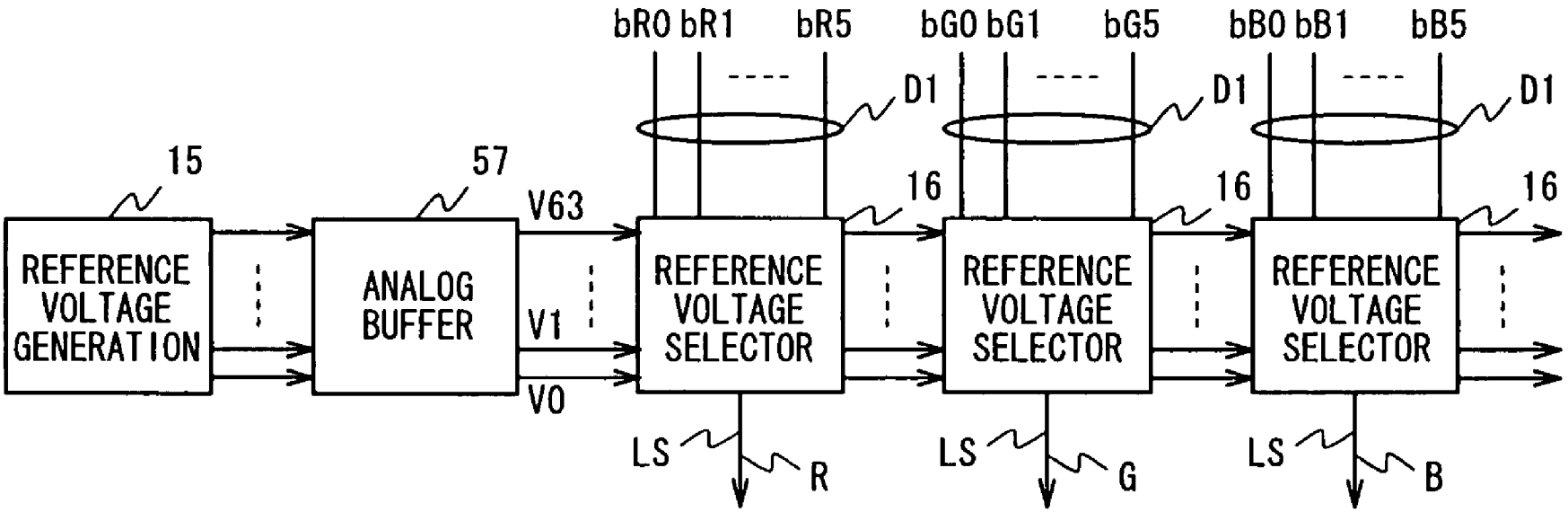
FIG. 19 is a block diagram showing part of the construction of a horizontal driving circuit applied to Embodiment 4 of the present invention.

FIG. 19 is a block diagram showing the constructions of an analog-to-digital conversion circuit and a buffer circuit, which are applied to a liquid crystal display according to Embodiment 4 of the present invention. In the liquid crystal display according to this embodiment, the reference signals V0 to V63 outputted from the reference voltage generation circuit 15 are processed by an analog buffer circuit 57, as mentioned above in connection with Embodiments 1 to 3, and are selected by the respective reference voltage selectors 16. In addition, a precharge circuit is provided at the output of each of the reference voltage selectors 16.

Even if the present invention is applied to the case where the reference voltages generated by the reference voltage generation circuit 15 are processed by the analog buffer circuit as in this embodiment, it is possible to obtain an advantage similar to that of the above-mentioned Embodiment 1.

(5) Embodiment 5

Figure 20:
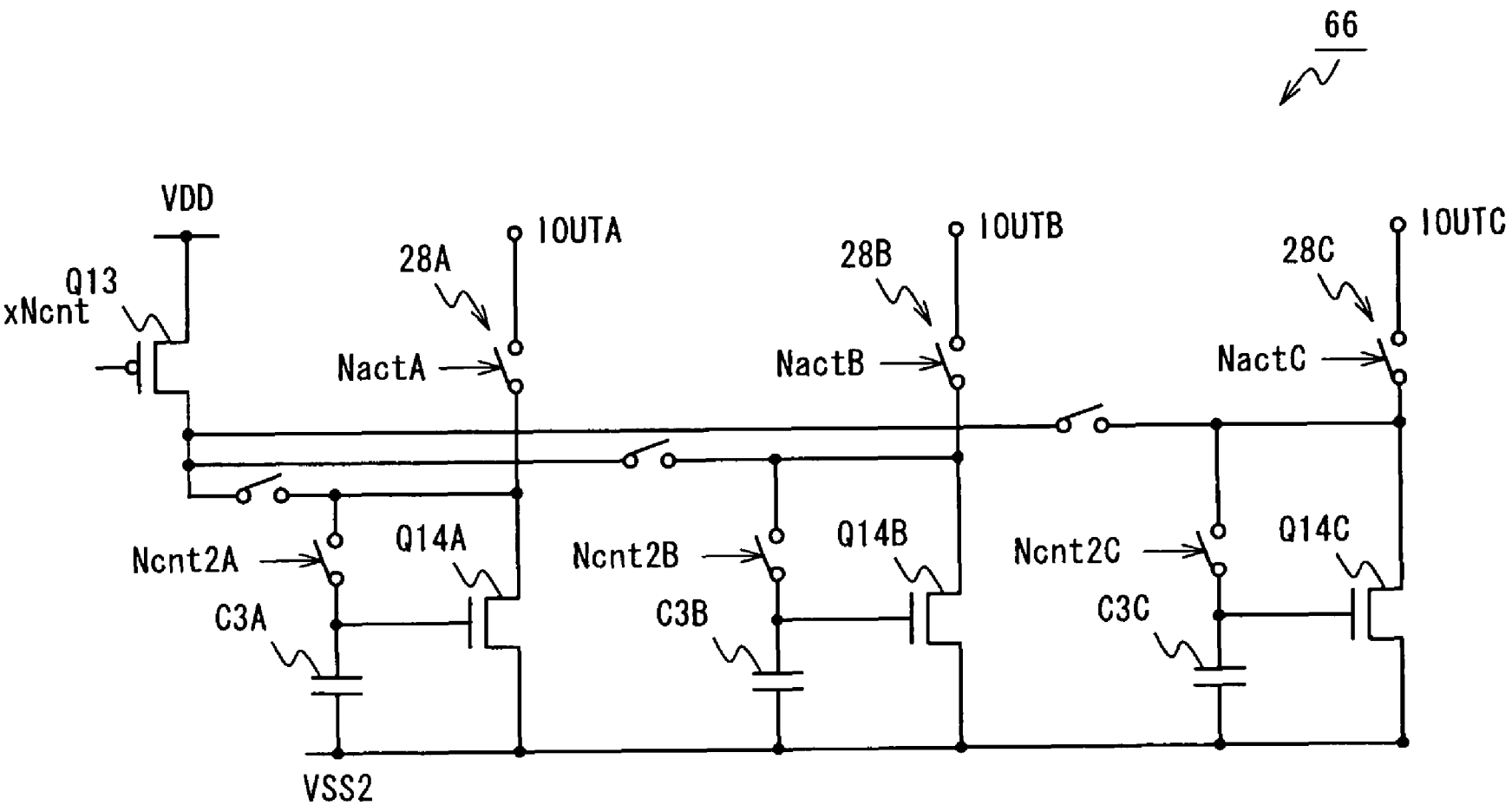
FIG. 20 is a connection diagram showing a constant current circuit according to Embodiment 5 of the present invention.

FIG. 20 is a connection diagram showing a constant current circuit according to Embodiment 5 of the present invention. A constant current circuit 66 is applied to various integrated circuits using TFTs. In the constant current circuit 66, a reference current from the transistor Q13 is sequentially supplied to a transistor Q14A and a sampling capacitor C3A, a transistor Q14B and a sampling capacitor C3B, and a transistor Q14C and a sampling capacitor C3C, and the gate-source voltages required to drive the respective transistors Q14A, Q14B and Q14C are set in the sampling capacitors C3A, C3B and C3C, and the respective transistors Q14A, Q14B and Q14C cause constant currents to flow out from corresponding driving targets by means of the gate-source voltages set in the sampling capacitors C3A, C3B and C3C.

Even in the case where a plurality of driving targets are driven by a single reference current, as in this embodiment, it is possible to obtain an advantage similar to that of Embodiment 1 by setting the gate-source voltage of each transistor in a sampling capacitor in a time-division manner and performing processing similar to that of the above-mentioned embodiments.

(6) Other Embodiments

Although the above description of each of the embodiments has referred to a case where a display section is driven by line inversion, the present invention is not limited to such an example, and it can be widely applied to other cases where a display section is driven by field inversion and the like.

Although the above description of each of the embodiments has referred to a case where the present invention is applied to a flat display device using TFT liquid crystal in which a display section and the like are formed on a glass substrate, the present invention is not limited to such an example, and it can be widely applied to various liquid crystal displays using CGS (Continuous Grain Silicon) and the like, and further, to various flat display devices, such as EL (Electro Luminescence) display devices.

Although the above description of each of the embodiments has referred to a case where a constant current circuit according to the present invention is applied to an analog buffer circuit of a liquid crystal display, the present invention is not limited to such an example, and it can be widely applied to constant current circuits associated with various integrated circuits.

INDUSTRIAL APPLICABILITY

The present invention can be applied to constant current circuits using active elements based on TFTs, CGS and the like, as well as to flat display devices using such constant current circuits.

DESCRIPTION OF REFERENCE NUMERALS

1 . . . liquid crystal display device, 2 . . . liquid crystal cell, 3,Q1 to Q14C . . . transistor, 4 . . . storage capacitor, 6 . . . display section, 7 . . . horizontal driving circuit, 8 . . . vertical driving circuit, 9 . . . shifter register, 10 . . . digital-to-analog conversion circuit, 11 . . . buffer circuit section, 15 . . . reference voltage generation circuit, 16 . . . reference voltage selector, 17 . . . timing generation circuit, 18 . . . buffer circuit, 20,40,50,57 . . . analog buffer circuits, 21 . . . precharge circuit, 22,23,24,27,28,31 to 35 . . . switch circuits, 26, 46,66 . . . constant current circuits, C1 to C3, C3A to C3C . . . capacitors

The invention claimed is:

1. A method for operating a constant current circuit of a buffer circuit that includes an analog buffer circuit and a precharge circuit, wherein a source of a buffer circuit transistor of the analog buffer circuit is a connection point for the constant current circuit, the analog buffer circuit, and the precharge circuit via a switch circuit of the analog buffer circuit, the method comprising:

during a first portion of a first time period:

connecting a sampling capacitor of the constant current circuit to a reference current source, the sampling capacitor being connected between a gate and a source of a first transistor, connecting a drain of the first transistor to the reference current source, and setting a voltage across the sampling capacitor to a voltage between the gate and the source of the first transistor produced while the first transistor is driven by a reference current of the reference current source;

during a second portion of the first time period:

cutting off the connection among the sampling capacitor, the first transistor and the reference current source by applying a first signal to a gate of a second transistor of the constant current circuit to place the second transistor in an off state, wherein the second transistor is connected between the drain of the first transistor and the reference current source, applying a second signal that is a logical inverse of said first signal to a gate of a third transistor of the constant current circuit to place the third transistor in the off state, wherein the third transistor is connected between the gate and drain of the first transistor;

during a second time period that is subsequent to the first time period:

connecting the drain of the first transistor to the connection point by applying a third signal to a gate of a fourth transistor of the constant current circuit to place the fourth transistor in an on state, wherein the fourth transistor is connected between the drain of the first transistor and the connection point, and driving the buffer circuit by a current of the first transistor due to the voltage between the gate and the source that is set in the sampling capacitor; and during a precharge period:

executing a precharge processing for the precharge period by disconnecting the precharge circuit for the precharge period from the connection point by placing the switch circuit of the analog buffer circuit in the off state, for a beginning portion of the precharge period, setting a first switch of the precharge circuit to the off state and a second switch of the precharge circuit to an on state to set a potential of a control signal by connecting the control signal to a signal line, and for a concluding portion of the precharge period, setting the first switch of the precharge circuit to the on state and the second switch of the precharge circuit to the off state to set the potential of the control signal to a ground by disconnecting the control signal from the signal line and by connecting the ground to the signal line, wherein a full time period comprises a combination of the first time period and the second time period, wherein the precharge period occurs within the full time period, begins at the same time as the first time period, and ends after the second time period begins, and wherein the first time period occurs within the beginning portion of the precharge period.

2. The method for operating a constant current circuit according to claim 1, further comprising:

consecutively repeating the first time period and the second time period.

3. A flat display device constructed so that a display section made of pixels arranged in a matrix form, a vertical driving circuit for sequentially selecting the pixels of the display section through gate lines, and a horizontal driving circuit for driving pixels selected through the gate lines, by signal lines of the display section, characterized in that:

the horizontal driving circuit comprises:

a digital-to-analog conversion circuit for performing digital-to-analog conversion processing of gradation data indicative of gradations of the pixels; and a buffer circuit for driving the signal lines by means of an output signal from the digital-to-analog conversion circuit, wherein the buffer circuit comprises an analog buffer circuit and a precharge circuit;

the buffer circuit drives the signal lines by a source follower circuit formed by connecting a constant current circuit to a source of a buffer circuit transistor of the analog buffer circuit, wherein the source of the buffer circuit transistor of the analog buffer circuit is a connection point for the constant current circuit, the analog buffer circuit, and the precharge circuit via a switch circuit of the analog buffer circuits; and the constant current circuit is configured to, during a first portion of a first time period:

connect a sampling capacitor of the constant current circuit to a reference current source, the sampling capacitor being connected between a gate and a source of a first transistor, connect a drain of the first transistor to a reference current source, and set a voltage across the sampling capacitor to a voltage between the gate and the source of the first transistor produced while the first transistor is driven by a reference current of the reference current source;

during a second portion of the first time period:

cut off the connection among the sampling capacitor, the first transistor and the reference current source by applying a first signal to a gate of a second transistor of the constant current circuit to place the second transistor in an off state, wherein the second transistor is connected between the drain of the first transistor and the reference current source, applying a second signal that is a logical inverse of said first signal to a gate of a third transistor of the constant current circuit to place the third transistor in the off state, wherein the third transistor is connected between the gate and drain of the first transistor; and during a second time period that is subsequent to the first time period:

connect the drain of the first transistor to the connection point by applying a third signal to a gate of a fourth transistor of the constant current circuit to place the fourth transistor in an on state, wherein the fourth transistor is connected between the drain of the first transistor and the connection point, connected between the drain of the first transistor and the connection point to place the fourth transistor in an on state, and drive buffer circuit by a current of the first transistor due to the first voltage between the gate and the source that is set in the sampling capacitor; and wherein during a precharge period the buffer circuit executes:

executes a precharge processing by disconnecting the precharge circuit for the precharge period from the connection point by placing the switch circuit of the analog buffer circuit in the off state, for a beginning portion of the precharge period, setting a first switch of the precharge circuit to the off state and a second switch of the precharge circuit to an on state to set a potential of a control signal by connecting the control signal to a signal line, and for a concluding portion of the precharge period, setting the first switch of the precharge circuit to the on state and the second switch of the precharge circuit to the off state to set the potential of the control signal to a ground by disconnecting the control signal from the signal line and by connecting the ground to the signal line, wherein a full time period comprises a combination of the first time period and the second time period, wherein the precharge period occurs within the full time period, begins at the same time as the first time period, and ends after the second time period begins, and wherein the first time period occurs within the beginning portion of the precharge period.

4. The flat display device according to claim 3, wherein the constant current circuit is configured for consecutively repeating the first time period and the second time period.

5. A constant current circuit of a buffer circuit that includes an analog buffer circuit and a precharge circuit, wherein a source of a buffer circuit transistor of the analog buffer circuit is a connection point for the constant current circuit, the analog buffer circuit, and the precharge circuit via a switch circuit of the analog, comprising:

a first transistor having a gate, a source, and a drain, the drain of the first transistor being configured for selective connection to a reference current source;

a sampling capacitor configured for selective connection between the gate and the source of the first transistor, for setting a voltage across the sampling capacitor to a voltage between the gate and the source of the first transistor produced while the first transistor is driven by a reference current of the reference current source, wherein the drain of the first transistor is selectively connected to a source of a transistor of a buffer circuit after setting said voltage, during a first portion of a first time period, across the sampling capacitor, for driving the buffer circuit by a current of the transistor due to the voltage between the gate and the source that is set in the sampling capacitor;

a second transistor having a gate, a source, and a drain, the drain of the second transistor being configured to selectively connect the first transistor and the reference current source, wherein the gate of the fourth transistor is configured to receive a first signal during a second portion of the first time period that enables the selective connection of the first transistor and the reference current source;

a third transistor having a gate, a source, and a drain, the third transistor being configured to set the voltage across the sampling capacitor, wherein the gate of the third transistor is configured to receive during the second portion of the first time period a second signal that is a logical inverse of said first signal and that enables the setting of the voltage across the sampling capacitor; and a fourth transistor having a gate, a source, and a drain, the fourth transistor being configured to selectively connect the source of the buffer circuit transistor of the analog buffer circuit and the drain of the first transistor, wherein the gate of the fourth transistor is configured to receive a third signal that enables the selective connection of the buffer circuit and the drain of the first transistor, and wherein said voltage is set and said selective connection is in a disconnected state within a precharge period for the display section to cause the constant current circuit to be temporarily connected to a source of a buffer circuit transistor of the buffer circuit during the precharge period, and wherein for the precharge period the buffer circuit executes a precharge processing by disconnecting the precharge circuit for the precharge period from the connectionpoint by placing the switch circuit of the analog buffer circuit in the off state, for a beginning portion of the precharge period, setting a first switch of the precharge circuit to the off state and a second switch of the precharge circuit to an on state to set a potential of a control signal by connecting the control signal to a signal line, and for a concluding portion of the precharge period, setting the first switch of the precharge circuit to the on state and the second switch of the precharge circuit to the off state to set the potential of the control signal to a ground by disconnecting the control signal from the signal line and by connecting the ground to the signal line, wherein the constant current circuit operates over a full time period comprising a the combination of the first time period and the second time period, wherein the precharge period occurs within the full time period, begins at the same time as the first time period, and ends after the second time period begins, and wherein the first time period occurs within the beginning portion of the precharge period.

6. The constant current circuit according to claim 5, wherein the constant current circuit is configured for consecutively repeating the first time period and the second time period.

7. The method for operating a constant current circuit according to claim 1, wherein the first transistor is a NMOS type transistor and the second transistor is a PMOS type transistor.

8. The flat display device according to claim 3, wherein the first transistor is a NMOS type transistor and the second transistor is a PMOS type transistor.

9. The constant current circuit according to claim 7, wherein the first transistor is a NMOS type transistor and the second transistor is a PMOS type transistor.

* * * * *